United States Patent [19]

Sahm

[11] Patent Number: 4,721,122

[45] Date of Patent: Jan. 26, 1988

[54] BRUSHING AND DRYING APPARATUS FOR HAIR

[76] Inventor: Jürgen Sahm, Weidstrasse 17, Kindhausen, Switzerland

[21] Appl. No.: 770,292

[22] Filed: Aug. 27, 1985

Related U.S. Application Data

[63] Continuation of Ser. No. 515,287, Jul. 19, 1983, which is a continuation of Ser. No. 176,747, Aug. 20, 1980, abandoned.

[51] Int. Cl.[4] ..... A45D 1/00

[52] U.S. Cl. ..... 132/9; 132/33 R

[58] Field of Search ..... 132/9, 33 R; 37/79

[56] References Cited

U.S. PATENT DOCUMENTS 2,097,808 11/1937 Zoberg ..... 132/36
2,156,687 5/1939 Grabner ..... 132/36
2,289,209 7/1942 Reiches ..... 132/9
2,990,460 11/1976 Shalvoy ..... 132/9
3,990,460 11/1976 Shalvoy ..... 132/9

*Primary Examiner*—Gregory E. McNeill
*Attorney, Agent, or Firm*—Gordon W. Hueschen

[57] ABSTRACT

A brushing and drying apparatus for hair comprises a device for generating an air flow which can be adjusted to a desired temperature and a number of curlers which can be fixed in the hair which is being treated. An air distributor device, such as an air distributor vessel, is connected or connectable with an air flow-generating device. The distributor device contains a multiplicity of air exit or outlet openings. There are provided a number of hoses which are connected at one end with the outlet openings of the distributor vessel and at the other end with a related curler.

2 Claims, 5 Drawing Figures

5a
7
6a
5
5a
6
6b
4
8
3a
4a
5b
3
2
1

BRUSHING AND DRYING APPARATUS FOR HAIR

BACKGROUND OF THE INVENTION

This is a continuation of application Ser. No. 515,287, filed July 19, 1983, which is a continuation of application Ser. No. 179,747, filed Aug. 20, 1980, now abandoned.

The present invention broadly relates to a new and improved construction of a hair styling apparatus, and, in particular, relates to a novel brushing and drying apparatus for hair.

The brushing and drying apparatus of this development is of the type comprising a number of perforated hollow curlers which can be fixed, for instance by means of clamps, in the hair which is being treated or styled. Further, there is provided a device for generating an air flow which can be regulated to a predetermined temperature.

The presently known hair drying techniques and the equipment which is available to beauticians in beauty parlours or the like do not enable brushing the hair when it is wet.

Usually it is necessary to at least pre-dry the hair, and thereafter to brush the same. On the one hand, this procedure is extremely time-consuming and, on the other hand, also precludes any rational mode of operation. The same considerations are equally applicable when a woman washes her hair at home and subsequently dries and brushes her hair.

SUMMARY OF THE INVENTION

Therefore, with the foregoing in mind it is a primary object of the present invention to provide a new and improved construction of brushing and drying apparatus for hair which is not associated with the aforementioned shortcomings and limitations of the prior art constructions.

Another and more specific object of the present invention aims at providing a new and improved brushing and drying apparatus by means of which it is possible to solve the aforediscussed problems with extremely modest equipment expenditure and in a most simple manner.

A further significant object of the present invention aims at providing a new and improved construction of hair curler for use with the brushing and drying apparatus of the invention.

Now in order to implement these and still further objects of the invention, which will become more readily apparent as the description proceeds, the brushing and drying apparatus of the aforementioned type, as contemplated by the present invention, is manifested by the features that there is provided an air distributor vessel which is operatively associated, meaning connected or connectable, with an air flowgenerating device. The distributor vessel comprises a multiplicity of air outlet openings. There are also provided a number of hoses or the like which are connectable at one end with the outlet openings of the distributor vessel and at their other end with a related curler.

The curlers can be constructed for instance as hollow brushes and preferably consist of a perforated cylindrical tube or pipe, whose one end, in the embodiment disclosed, may be closed. The actual brush is introduced through the other curler end, and in the end position the bristles of the brush extend through holes of the jacket or outer surface of the tube.

For curling the hair the hollow brushes can be coupled with a handle or handgrip. After release of the handle there is connected a hose with the internal space of the brush.

Another type of curler consists of a hollow, elongate curler body, the side walls of which are provided with air outlet or exit openings and a coupling element for the connection of the curler with an air infeed hose. At the air inlet or infeed end and at the coupling element of the curler there are provided branching or branched channels for the air flow. These branched channels extend in a manner such that they terminate externally of the side walls of the curler and allow the air flow to flow parallel to the curler body.

When part of the hoses are not used then there can be advantageously provided means in order to obturate part of the air outlet or exit openings of the distributor vessel or, however, the brush-side ends of the hoses. These closure means can consist of, by way of example and not limitation, insertable covers or plugs, for instance formed of rubber.

The air flow-distributor device can comprise a conventional air dryer, typically for instance a fan or blower. With professional equipment the air flow-generating device and the distributor vessel together with the hoses are preferably arranged upon a mobile frame or housing.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
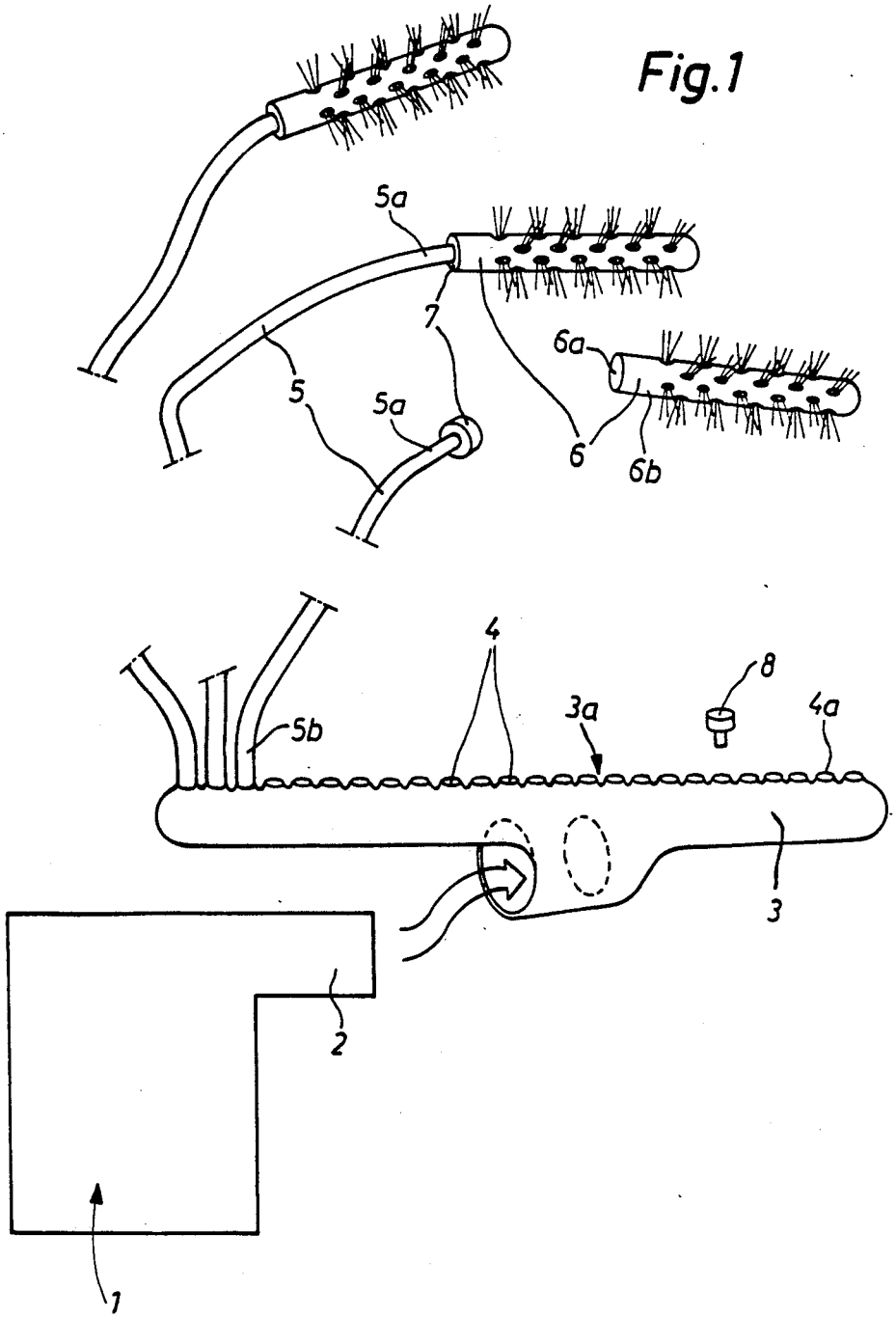
FIG. 1 schematically illustrates the major components of a first exemplary embodiment of hair brushing and drying apparatus according to the invention.
Figure 4:
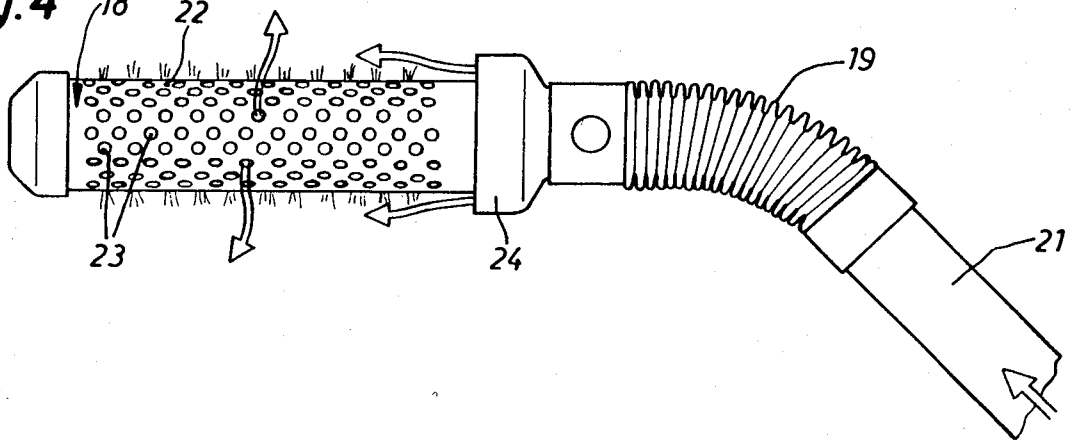
FIG. 4 is a cross-sectional view of a curler constructed according to the invention.
Figure 5:
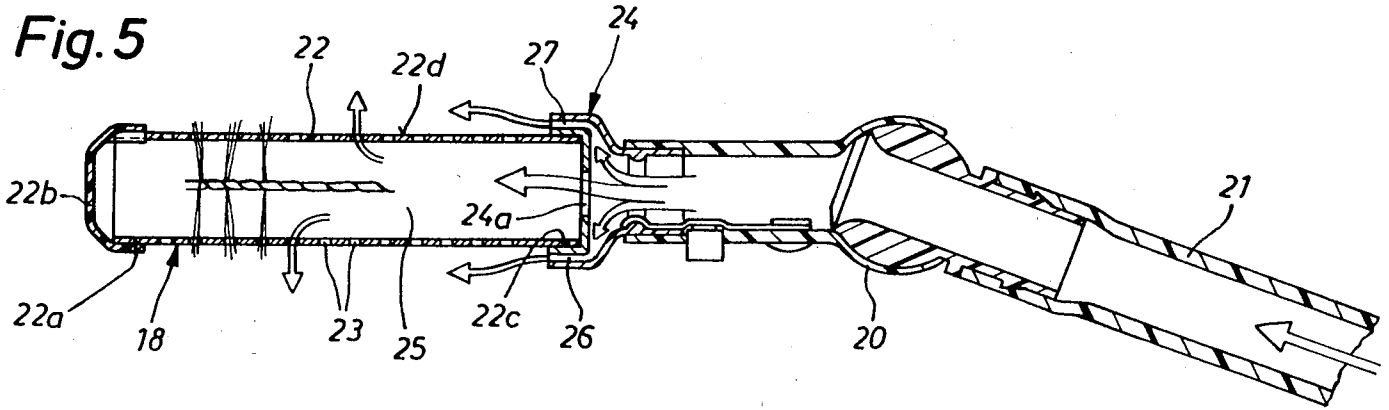
FIG. 5 illustrates the curler of FIG. 4 in sectional view, but provided with a different hinge construction.

Describing now the drawings, in FIG. 1 there is schematically illustrated a brushing and drying apparatus for hair which will be seen to comprise a suitable device 1, such as a conventional hair blower or fan, which has only been purely schematically illustrated, which serves to generate an air flow having a certain or preselected temperature. Connected with the outlet end 2 of the air flow-generating device 1 is an air distributor device 3, herein the form of a distributor vessel, which is equipped with a multiplicity of relatively small air exit or outlet openings 4. A number of flexible hoses or pipes 5 or equivalent structure can be connected with the openings 4, and a number of hollow brushes or brush elements 6 or other curlers, as shown in FIGS. 4 and 5, are provided at which there can be connected in each case the free end of the hollow brushes or other curlers.

At the air exit side 3*a* of the air distribution or distributor device or vessel 3 the other ends 5*b* of the hoses 5 or the like can be connected with the studs 4*a* of the air outlet openings 4 or such hose ends 5*b* can themselves be inserted into the related openings 4.

In consideration of the particular construction of the hollow brushes 6 the brush openings 6*a* leading to the not particularly referenced internal space of the brushes 6 are relatively large. The connection of each hose 5 with the brush 6 can be accomplished, by way of example, by means of a rubber collar or connector 7 which is fixedly seated upon the corresponding hose 5 and while mounted on such hose can be plug-connected into the tubular portion or tube 6b of the related brush 6.

In the event that only part of the hoses 5 are needed, then it is possible to either close the brush-side hose ends 5*b* or the air outlet openings 4 of the distributor vessel 3 by a pluggable cover member or plug 8 or the like, so that there cannot arise any undesired pressure drop in the air flow.

With the illustrated apparatus it is possible to curl into the washed wet hair the brushes or curlers 6 which can be of different size. By connecting these brushes 6 with the air flow it is then possible to simultaneously dry and brush the hair.

Figure 3:
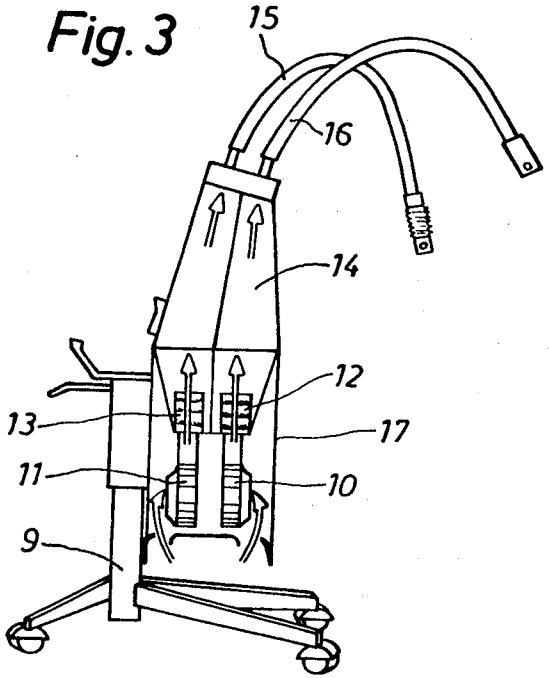
FIG. 3 illustrates the apparatus of FIG. 2 in side view and partially in sectional view.
Figure 2:
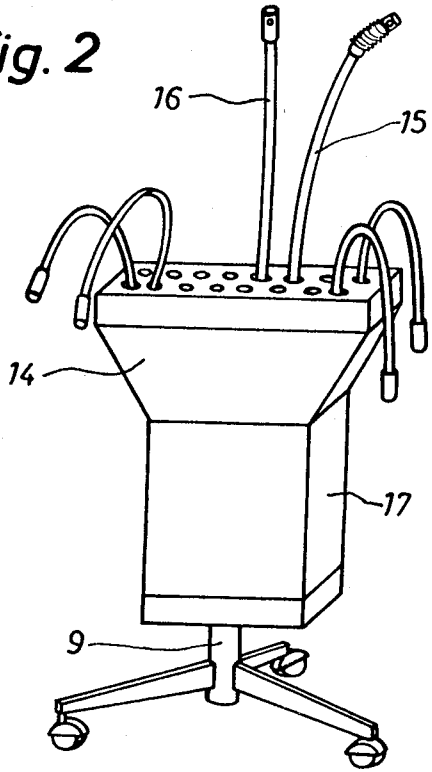
FIG. 2 is a perspective view of a modified construction of hair drying and brushing apparatus constituting a mobile or movable unit.

Now in FIGS. 2 and 3 of the drawings there is illustrated an exemplary embodiment of apparatus which can be arranged upon the mobile or travelling frame or support 9 of conventional design. With this construction there are provided two ventilators or fans 10 and 11 following which there are operatively connected heaters 12 and 13 for heating-up the sucked-up air. The thus prepared air is infed to a distributor device 14, here in the form of a distributor cabinet or vessel, at which there are connected the hoses 15 and 16 which lead to the brushes or curlers 6. The entire arrangement is mounted in a suitable housing 17.

Continuing, in FIGS. 4 and 5 there is shown a particularly suitable construction of curler or brush 18 which is connected, in the showing of FIG. 4 by means of a hinge structure 19, and in the showing of FIG. 5 by means of a hinge structure 20, with a hose 21 leading from the distributor vessel or cabinet 3 or 14 as the case may be. In the arrangement of FIG. 4 the hinge means 19 may be constituted by a flexible or bellows-like hinge element, whereas in the arrangement of FIG. 5 the hinge means 20 may be constituted by a conventional ball-and-socket hinge joint.

The structural details of the curler or brush 18 will be apparent from the showing of FIG. 5. It will be seen to comprise an elongate, tubular-shaped body member 22 having a multiplicity of holes or openings 23 through which air can essentially out flow in radial direction. The one end 22*a* of the body or body member 22 can be conveniently closed, for instance by means of the closure of cover member 22*b*, whereas at the other end 22*c* of such body member 22 there is provided a coupling or connection element 24, here shown for instance as a substantially cup-shaped connection element 24. This connection or coupling element 24 is structured such that part of the infed air flow reaches the internal space or chamber 25 of the curler 18, specifically by flowing through a central opening 24*a* of such connection element 24, whereas another part of the air flow or stream is guided towards the outside in the direction of the peripheral region of such connection or coupling element 24. This air then can flow through the outlet channels 26 and 27, and specifically, approximately in the lengthwise direction of the curler over its outer surface 22*d*. Due to this particular curler design there is obtained an exceptionally effective drying effect.

While there are shown and described present preferred embodiments of the invention, it is to be distinctly understood that the invention is not limited thereto, but may be otherwise variously embodied and practiced within the scope of the following claims. Accordingly,

What is claimed is:

1. A hair drying apparatus comprising:

a cabinet mounted on a mobile base which has a distributor having at the top thereof, a substantially flat, horizontal upper surface provided with a plurality of individual, flexible hoses communicating with the interior of said distributor through said upper surface;

means for introducing heated air into the interior of said distributor comprising heating elements adjacent the bottom thereof;

blower means for blowing ambient air through said heating elements into the interior of said distributor;

a plurality of drier means; and a plurality of drier means connectors adapted to connect individual, drier means with said individual flexible hoses.

2. Hair drying apparatus of claim 1, in which said drier means comprises:

a tubular, substantially elongate body having an air infeed end and side walls provided with air outlet openings;

said driver means further being provided with a coupling element for connecting said air infeed end with a flexible hose of said distributor; and air-flow means defining branch channels for providing air flow at said air infeed end of said drier means, one of said branch channels comprising a tubular member concentric with said tubular body and defining an annular outlet port extending along the side walls of said body a distance such as to constrain the air to flow essentially parallel to the exterior walls of said body and another branch of said channel means communicating with the interior of said hollow body to provide air for discharge radially through said outlet openings, said curler body having a closed end whereby all the air is constrained to flow through said annular outlet port and radially through said outlet openings.

* * * * *

UNITED STATES PATENT AND TRADEMARK OFFICE

CERTIFICATE OF CORRECTION

PATENT NO. : 4,721,122

DATED : January 26, 1988

INVENTOR(S) : Jürgen Sahm

It is certified that error appears in the above-identified patent and that said Letters Patent is hereby corrected as shown below:

Title Page, [63] Related U.S. Application Data, line 2; "176,747" should read -- 179,747 --

Title Page, [56] References Cited, U.S. PATENT DOCUMENTS, line 4; delete this line 4 reading "2,990,460 11/1976 Shalvoy ... .... 132/9"

Title Page, [56] References Cited (second column on Title Page) under the last "U.S. PATENT DOCUMENT" beginning with the patent number "3,990,460" the following should be inserted:

-- FOREIGN PATENT DOCUMENT 2835119 3/1979 Fed. Rep. of Germany ..... -- *

Col. 1, line 45; "aforediscussed" should read -- afore-discussed--

Col. 1, line 58; "flowgenerating" should read -- flow-generating --

Col. 2, line 61; "herein" should read -- here in --

Col. 4, line 35; delete the comma "," after"individual" (first occurrence) and insert a comma -- , -- after "individual" (second occurrence)

Signed and Sealed this

Twentieth Day of September, 1988

*Attest:*

*Attesting Officer*

DONALD J. QUIGG

*Commissioner of Patents and Trademarks*